US008900005B2

(12) United States Patent
Taylor

(10) Patent No.: US 8,900,005 B2
(45) Date of Patent: Dec. 2, 2014

(54) INSULATION DISPLACEMENT TERMINAL SYSTEM WITH REGULATED WIRE COMPRESSION

(75) Inventor: Robert N. Taylor, Coventry, RI (US)

(73) Assignee: Pancon LLC, East Taunton, MA (US)

( * ) Notice: Subject to any disclaimer, the term of this patent is extended or adjusted under 35 U.S.C. 154(b) by 447 days.

(21) Appl. No.: 13/510,475

(22) PCT Filed: Jul. 12, 2010

(86) PCT No.: PCT/US2010/041656

§ 371 (c)(1),
(2), (4) Date: Aug. 21, 2012

(87) PCT Pub. No.: WO2011/019466

PCT Pub. Date: Feb. 17, 2011

(65) Prior Publication Data

US 2012/0315785 A1 Dec. 13, 2012

Related U.S. Application Data

(60) Provisional application No. 61/232,916, filed on Aug. 11, 2009.

(51) Int. Cl.

| | |
|---|---|
| ***H01R 11/20*** | (2006.01) |
| ***H01R 43/01*** | (2006.01) |
| ***H01R 4/24*** | (2006.01) |

(52) U.S. Cl.

CPC ..... *H01R 4/245* (2013.01); *H01R 43/01* (2013.01)

USPC ..... 439/418; 439/417

(58) Field of Classification Search

USPC ..... 439/417, 418, 402, 404

See application file for complete search history.

(56) References Cited

U.S. PATENT DOCUMENTS

| | | | | |
|---|---|---|---|---|
| 2,738,479 | A * | 3/1956 | Gibson | 439/395 |
| 3,202,957 | A * | 8/1965 | Leach | 439/392 |
| 3,350,679 | A * | 10/1967 | Marley et al. | 439/865 |
| 4,806,119 | A * | 2/1989 | Herfort et al. | 439/395 |
| 4,859,203 | A * | 8/1989 | Eckhaus | 439/404 |
| 4,861,278 | A * | 8/1989 | McBride et al. | 439/395 |
| 4,904,203 | A * | 2/1990 | Wang | 439/399 |
| 4,917,633 | A * | 4/1990 | Lacoste | 439/722 |
| 5,378,171 | A * | 1/1995 | Czerlanis | 439/425 |
| 5,399,098 | A * | 3/1995 | Marshall et al. | 439/398 |
| 5,549,484 | A * | 8/1996 | Chen | 439/417 |
| 5,636,306 | A * | 6/1997 | Mock et al. | 385/101 |
| 5,864,090 | A * | 1/1999 | Wright | 174/40 CC |
| 5,993,244 | A * | 11/1999 | Bechaz et al. | 439/417 |
| 6,139,353 | A * | 10/2000 | Muz | 439/417 |
| 6,176,732 | B1 * | 1/2001 | Schultz et al. | 439/404 |
| 6,247,960 | B1 * | 6/2001 | Daoud | 439/417 |
| 7,121,871 | B2 * | 10/2006 | Duesterhoeft et al. | 439/417 |
| 7,134,903 | B1 * | 11/2006 | Pavlovic | 439/404 |

(Continued)

FOREIGN PATENT DOCUMENTS

| | | |
|---|---|---|
| EP | 0287263 | 10/1988 |
| WO | 2007/143805 | 12/2007 |

*Primary Examiner* — Ross Gushi

(74) *Attorney, Agent, or Firm* — Occhiuti & Rohlicek LLP

(57) ABSTRACT

An insulation displacement terminal system (10) provides for a stop limiting engagement of two opposed insulation displacement plates (15, 16) and a catch (70) retaining the plates (15, 16) against separation to precisely define an aperture (84) holding the conductor for improved reliability and electrical contact.

20 Claims, 6 Drawing Sheets

(56) References Cited

U.S. PATENT DOCUMENTS

| | | | | |
|---|---|---|---|---|
| 7,347,717 | B2 * | 3/2008 | Taylor | 439/409 |
| 7,413,465 | B2 * | 8/2008 | Taylor | 439/409 |
| 7,611,363 | B2 * | 11/2009 | Nakamura | 439/108 |
| 8,109,783 | B2 * | 2/2012 | Bishop et al. | 439/404 |
| 8,267,715 | B2 * | 9/2012 | Roosdorp et al. | 439/404 |
| 8,758,041 | B2 * | 6/2014 | Bishop et al. | 439/404 |
| 2003/0054685 | A1 | 3/2003 | Shan | |
| 2006/0160403 | A1 * | 7/2006 | Duesterhoeft et al. | 439/404 |
| 2007/0243751 | A1 | 10/2007 | Taylor | |
| 2007/0243752 | A1 * | 10/2007 | Taylor | 439/409 |
| 2013/0164968 | A1 * | 6/2013 | Bishop et al. | 439/404 |

* cited by examiner

INSULATION DISPLACEMENT TERMINAL SYSTEM WITH REGULATED WIRE COMPRESSION

CROSS REFERENCE TO RELATED APPLICATIONS

This application is the national stage application of PCT/US2010/041656, filed Jul. 12, 2010, which claims priority to U.S. Application No. 61/232,916, filed Aug. 11, 2009. The contents of the aforementioned applications are incorporated herein in their entirety.

TECHNICAL FIELD

This invention relates to insulation displacement systems providing electrical connections, including insulation displacement systems used as a tap or splice.

BACKGROUND OF THE INVENTION

Insulation displacement systems (IDS) provide a convenient way to establish an electrical connection between an electrical conductor and an electrical contact (e.g., an electric terminal, electric interface, a second electric wire, etc.).

A conventional IDS includes a terminal with an open or "tuning fork" slot extending from one edge of the terminal. A section of an electrical cable (which includes a single or multi-strand electrical conductor surrounded by an insulator) is directed into the slot in such a way that the longitudinal axis of the electrical cable and the longitudinal axis of the slot are substantially perpendicular. Typically, the width of the slot is narrower than the diameter of the conductor bundle. Thus, as the insulated cable is pressed into the slot, the edges of the slot cut into the insulation surrounding the electrical conductor(s) to displace the insulator, thereby exposing the electrical conductor(s). Additionally, as the exposed electrical conductor continues to travel into the slot, making contact with the electrically conducting edges of the slot, the substantially round shape of the conductor bundle is compressed into an oval shape, establishing an electric connection with the electrical contact.

U.S. Pat. No. 7,347,717 issued Mar. 25, 2008 and hereby incorporated by reference, describes an insulation-displacement system that uses two insulation displacement terminals with opposed overlapping slots. As the terminals are moved together, they define a narrowing opening which captures an electrical cable to displace its insulation and compress the conductor. The opening formed from the overlapping slots provides improved connection between the wire and terminals by better holding the conductor in a compressed state on multiple sides for more even distribution of power density among the wires of the bundle and better resistance to dislodgement by vibration.

SUMMARY OF THE INVENTION

The present invention provides an insulation displacement system that uses opposed overlapping slots together with a spring loaded latch and stop to automatically and accurately control the size of the resulting opening for a particular gauge of conductor. By precise aperture control using the latch and stop, compression of the cable conductor is obtained on all sides at not less than, or more than, a predetermined degree of compression, determined by the aperture size.

This automatic latching prevents compression loss, ensuring greater current handling capability up to the rating of the conductors. This makes practical insulation displacement splices between two current-carrying conductors which may be of the same or different gauges and/or materials.

The present design, in one embodiment, may also provide a closed slot in distinction from the open slot of tuning fork designs. The closed slot, implemented as a keyhole, conveniently captures the wire before insulation displacement, simplifying the management of the conductors during all splice type operations, but especially where two wires are simultaneously compressed.

Specifically then, the present invention provides an insulation displacement system having a first insulation displacement terminal (IDT) and a second IDT, the first IDT adapted to slidably engage the second IDT along an engagement axis. Each of the first and second IDTs includes an associated plate that includes a slot extending along the engagement axis and configured to receive an electrical wire including a conductor surrounded by an insulator and to electrically connect to the electrical wire upon displacement of the insulator. The IDTs further provide stop surfaces limiting the engagement of the first and second IDTs at a full-engaged position so that overlap of the slots defines an aperture having an area corresponding to a predetermined gauge of the conductor and detent surfaces releasably holding the first and second IDTs at the full-engaged position against disengagement.

It is thus a feature of at least one embodiment of the invention to provide positive control of the engagement of insulation displacement terminals about the conductors of connecting wires to provide for superior control of compression of the conductor.

The first and second IDTs may further provide alignment surfaces restraining relative motion of the first and second IDTs to a sliding abutment along the engagement axis.

It is thus a feature of at least one embodiment of the invention to retain the first and second IDTs together before assembly to simplify their use.

The alignment surfaces on the first IDT may be first and second rolled edges extending parallel to the engagement axis to receive and capture corresponding first and second edges of the second IDT providing alignment surfaces of the second IDT.

It is thus a feature of at least one embodiment of the invention to provide a simple method of guiding assembly of the first and second IDTs that can be fabricated with readily available stamping and forming equipment and that provides both lateral guidance and compression of the IDTs together.

The stop surfaces on the first IDT may be at least one leading edge of the first and second rolled edges receiving the second IDT and the stop surfaces on the second IDT may be at least one flange extending outwardly from the plate perpendicular to the engagement axis to abut at least one leading edge of the first and second rolled edges at the full-engaged position.

It is thus a feature of at least one embodiment of the invention to employ the rolled edges as portions of the stop limiting engagement of the first and second IDT.

Alternatively, the detent surface on the second IDT may be a cantilevered tab forming a part of the plate of the second IDT and providing a spring-loaded catch biased to flex into the opening when the cantilevered tab and opening are aligned at the full-engaged position.

It is thus a feature of at least one embodiment of the invention to provide a detent system that simplifies manufacturing of the detent.

The detent surface on the first IDT is an opening in at least one of the first and second rolled edges and the detent surface on the second IDT is a spring-loaded catch biased outward to be received by the opening when the spring-loaded catch and opening are aligned at the full-engaged position.

It is thus a feature of at least one embodiment of the invention to provide a simple catch mechanism that may permit later separation of the parts.

The spring-loaded catch may be sized to be retained below an outer surface of the opening when engaged with the opening.

It is thus a feature of at least one embodiment of the invention to prevent accidental disengagement of the catch.

The insulation displacement system of the spring-loaded catch is attached to a cantilevered finger forming a part of the plate of the second IDT.

It is thus a feature of at least one embodiment of the invention to provide a catch mechanism that may be readily fabricated from a stamped plate.

The first IDT may be substantially planar.

It is thus a feature of at least one embodiment of the invention to provide one IDT providing the present benefits that may be inexpensively manufactured without significant forming operations.

The second IDT may provide electrical communication to a crimp barrel for deformation about a wire conductor.

It is thus a feature of at least one embodiment of the invention to provide an insulation displacement terminal that may connect by crimping to other conductors.

The opening formed by overlap of the slots of the first and second IDT at a full-engagement position may provide a predetermined shape and area.

It is thus a feature of at least one embodiment of the invention to control the aperture for more uniform conduct or compression.

The slots of at least one of the first and second IDTs may join with a clearance hole allowing free passage of the electrical wire of the conductor surrounded by an insulator, the slots and clearance holes are positioned so that at a partial-engaged position of the first and second IDTs along the engagement axis before reaching the full-engaged position, the clearance holes of the first and second IDTs align and, in the full-engaged position, only overlapping portion of the slots of the first and second IDTs align.

It is thus a feature of at least one embodiment of the invention to provide a mechanism for capturing the wire before insulation displacement.

The junction of the slots and clearance holes of at least one of the first and second IDTs may provide at least one chisel-edge extending generally along an axis of the conductor when the conductor is received by the clearance hole, the chisel-edge oriented to cut insulation from the conductor when the conductor is moved from the clearance hole to the slot.

It is thus a feature of at least one embodiment of the invention to provide a mechanism for connecting to wires having resilient insulating outer coatings.

The slots may have different widths for engaging conductors of different gauges and the clearance holes associated with a slot for the narrower gauge is elongated along the insertion axis.

It is thus a feature of at least one embodiment of the invention to permit the interconnection of different gauges of wire with proper compression of each.

The clearance hole and slot may define a continuous periphery surrounded by material of the plate It is thus a feature of at least one embodiment of the invention to permit a capturing of the conductor before insulation displacement and to provide greater mechanical resistance to creep or deformation in the slot walls.

The first and second IDTs may provide multiples slots having clearance holes aligned at the partial-engaged position and overlapping portions of the insulation displacement slots aligned at the full-engaged position.

It is thus a feature of at least one embodiment of the invention to permit the joining of two conductors together using insulation displacement techniques.

The plates may be steel.

It is thus a feature of at least one embodiment of the invention to permit joining of dissimilar conductors such as copper and aluminum intervening steel IDTs.

These particular features and advantages may apply to only some embodiments falling within the claims and thus do not define the scope of the invention.

DETAILED DESCRIPTION OF THE PREFERRED EMBODIMENT

Figures 1A, 1B, 1C:
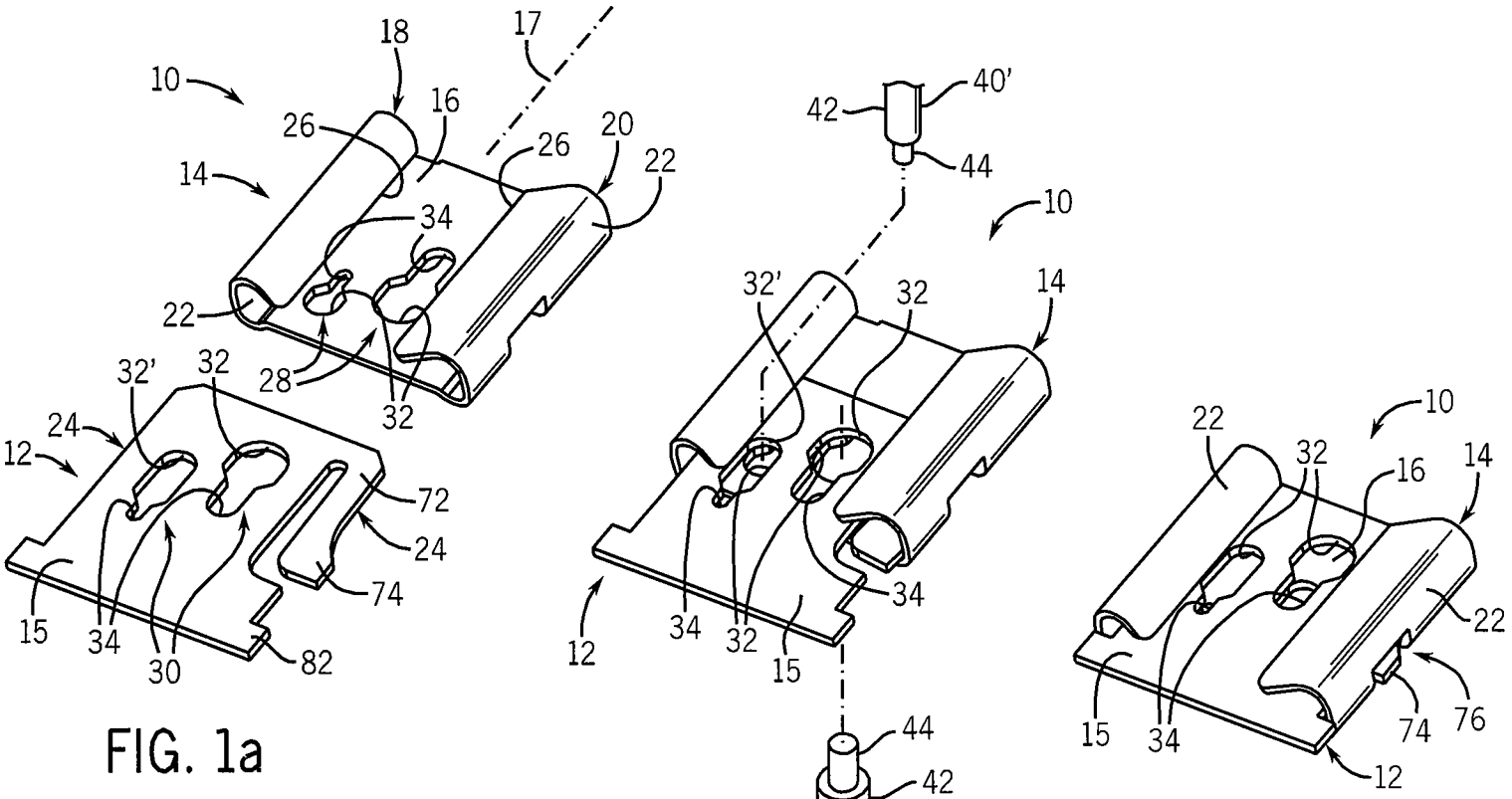
FIG. 1*a* is a perspective view of first and second insulation displacement terminals in one embodiment of the present invention as aligned before connection.
FIG. 1*b* is a figure similar to that of FIG. 1*a* showing the first and second insulation displacement terminals in the partial-engaged position.
FIG. 1*c* is a figure similar to FIGS. 1*a-b* showing the first and second insulation displacement terminals in a full-engaged position.

Referring now to FIG. 1*a*, an insulation displacement system (IDS) 10 of the present invention may include a first insulation displacement terminal (IDT) 12 formed of an electrically conductive substantially flat plate 15 and a second insulation displacement terminal (IDT) 14 having an electrically conductive planar base 16 that may receive the plate 15 thereagainst in sliding engagement along an axis 17, with a broad surface of the lower surface of the flat plate abutting a broad upper surface of the planar base 16.

The base 16 is flanked across axis 17 by rolled edges 18 and 20 that curve up away from a plane of the base 16 to provide upwardly extending walls 22 that guide opposed edges 24 of the flat plate 15 when the first IDT 12 is engaged with the second IDT 14 as shown in FIGS. 1*b-c*. The rolled edges 18 and 20 further extend inward above the walls 22 to curve downward over the top of base 16 to provide downwardly extending rails 26 that press downward against an upper surface of the plate 15 to retain the plate 15 against the base 16 when the first and second IDTs 12 and 14 are connected in abutting configuration as described above and as shown in FIGS. 1*b-c*.

The plate 15 and the base 16 may have one or more keyholes 28 and 30 providing apertures with closed peripheries in the plate 15 and base 16 respectively. Each keyhole 28 and 30 provides a clearance hole 32 communicating at its edge with a narrower insulation displacement slot 34, the latter extending along axis 17. These slots 34 of the keyholes 28 of the base 16 extend in a first direction from the clearance hole 32 away from first IDT 12 during engagement with the first IDT 12 while the slots 34 of the keyholes 30 of the plate 15 extend in an second opposite direction from the clearance hole 32 away from the second IDT 14 during engagement with the second IDT 14.

Clearance holes 32 are sized to provide free passage of cables 40, 40', including their outer electrical insulation 42 and center conductor(s) 44, through the clearance holes 32, 32' (respectively) without interference. The slots 34 are sized to be equal to or slightly smaller than the outer diameter of the conductor 44 (individual wire or wire bundle) to displace the insulation 42 from the conductor 44 when the cable 40, 40' is within the slot 34 and to make good electrical connection between the edges of the slots 34 and the conductors 44. As shown, two or more keyholes 28 and 30 may be provided in each of the first and second IDTs 12 and 14 adapted for cables 40 and 40' having conductors 44 of different diameter or materials.

Referring now to FIG. 1*b*, in a partial-engaged position between the first IDT 12 and the second IDT 14 with plate 15 partially inserted within the rolled edges 18 and 20 (partial-engaged position), the clearance holes 32 of keyholes 28 and the clearance holes 32 of keyholes 30 will align permitting free passage of the cable 40, 40' therethrough with interaction perpendicular to the plane of the plate 15 and base 16 and to axis 17 without disturbing the insulation 42 of the cable 40, 40'.

With the cables 40, 40' within the clearance holes 32 as aligned in FIG. 1*b*, the first and second IDTs 12 and 14 may be further engaged to a full-engaged position shown in FIG. 1*c* so that the clearance holes 32 are no longer aligned between plate 15 and base 16, but only portions of the slots 34 of the keyholes 28 and 30 are aligned forcing the cables 40, 40' into the slots 34 causing a displacement of the insulation 42 from the cables 40 and electrical connection between the plate 15 and base 16 with the center conductors 44.

Figure 2:
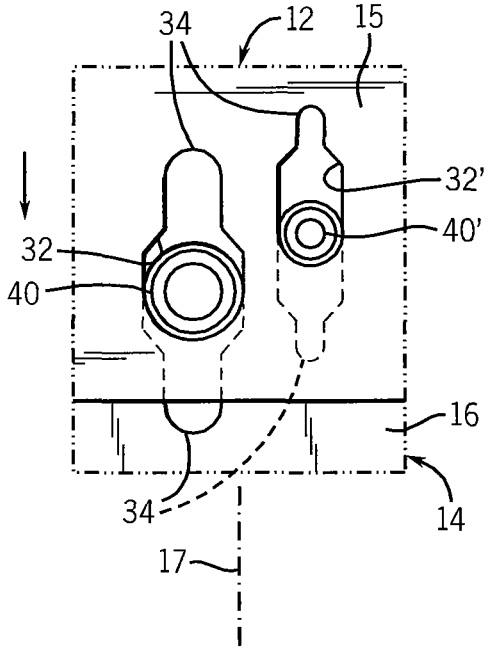
FIG. 2 is a cross-sectional view in elevation through two electrical cables installed on the insulation displacement terminal of the present invention used as a splice and employing two keyhole slots to capture the cables before insulation displacement.

Referring now to FIG. 2, the present invention may conveniently be used to form a splice between two cables 40 and 40' permitting high current carrying capacity up to the rated current of the particular conductors 44. In this case, the clearance holes 32, in alignment prior to the insulation displacement, allow partial capture of the cables 40 and 40' greatly simplifying the simultaneous insulation displacement of the two cables 40 and 40'.

In the shown embodiment of FIG. 2, where the conductor of cable 40' is smaller than the conductor of cable 40, a clearance hole 32' may be made oblong to extend a greater length along the axis 17 so that the conductor of cable 40' need not slide along an extensive length of the slot 34 such as may unduly abrade the conductor before the full-engaged position is reached.

As is depicted, the keyholes 28 and 30 need not be aligned in the plate 15 and the base 16 (along a line perpendicular to engagement axis 17) but may be staggered along the axis 17 to better preserve the structural rigidity of the plate 15 and the base 16. Similarly, the keyholes 28 and 30 may be of different sizes appropriate for different gauges of conductor. Regardless of the gauge of conductor 44 and thus the diameter of the clearance holes 32 and the width of the slots 34, the end slots 34 will have comparable displacement from centers of the clearance holes 32 so as to align in the full-engaged position to produce the desired apertures 84 (shown in FIG. 3*c*) with a single relative displacement of the plate 15 and the base 16.

The shape of keyholes 28 and 30, which each provide a closed slot, in some embodiments also may improve manufacturability by stabilizing the plate 15 and the base 16 on all sides of the keyholes 28 and 30 reducing distortion during a stamping process and in subsequent use.

It should be noted that the ability to divide the insulation displacing portions of the IDS 10 among plate 15 and the base 16 allows the plates to be thinner (e.g., 12-15 mils) and thus to each better penetrate even particularly resistant insulations such as Kevlar, while offsetting this thinness, which reduces contact area with the conductors 44, by the ability of current to flow not to a single plate 15 or base 16 but to both of the overlapping plate 15 and the base 16 which both surround each conductor 44.

Figure 3A:
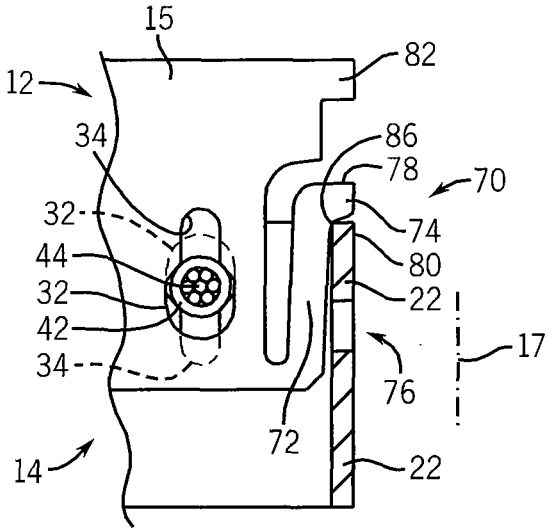
FIGS. 3*a-c* are fragmentary elevational views of the first and second insulation displacement terminals in a partial-engaged position (FIG. 3*a*), a full-engaged position (FIG. 3*c*), and a position in-between showing a latching mechanism and overlap of a portion of the slots of the keyholes to provide a defined aperture completely surrounding the conductor of an installed cable.
Figure 3B:
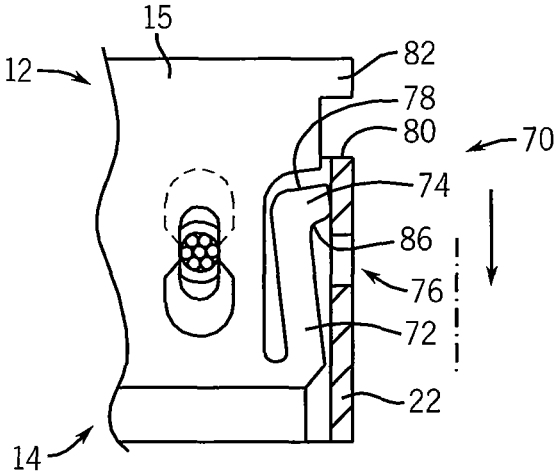
Figure 3C:
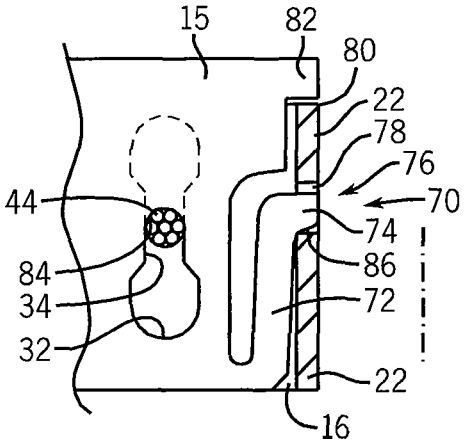

Referring now to FIGS. 3*a-c*, the reliability of the high current carrying capabilities of IDS 10 is preserved by a catch mechanism 70 which precisely controls the engagement of the first and second IDTs 12 and 14 when in the full-engaged position configuration of FIG. 3*c*. The catch mechanism 70 comprises a flexible finger 72 forming one edge 24 of the plate 15 that has an outwardly extending catch 74 that in the full-engaged position of FIG. 1*c* fits into an aperture 76 in the wall 22 of the IDT 14 driven to engagement by release of flexible finger 72. As so engaged, the outermost extent of the catch 74 is flush with or recessed within the outer surface of the aperture 76 so as to prevent accidental disengagement by contact with blunt surfaces.

In the full-engaged position of FIG. 1*c*, an upper edge 78 of the catch 74 abuts a corresponding lower edge of the aperture 76 preventing movement in separation of the IDTs 12 and 14 from the full-engaged position of FIG. 1*c* to the partial-engaged position of FIG. 1*b*. Further movement toward engagement is prevented by interference between a forward edge 80 of the wall 22 and a stop lip 82 formed as a flange in the plate 15 and extending laterally therefrom. When the catch 74 is so engaged, the relative position of the plate 15 and base 16 is precisely controlled, further controlling an aperture 84 formed by the overlap of portions of the slots 34 of plate 15 and base 16. Thus, a precisely defined opening of aperture 84 and, thus, precisely defined compression of the conductor 44 may be attained. In one embodiment the aperture 84 may be approximately circular to provide substantially equal inward compression on the conductor 44 or may be any other predefined shape and area. Generally, engagement of the catch 74 and the stop surfaces of the forward edge 80 prevent any significant relative motion of the IDTs 12 and 14 along the axis 17.

Referring to FIGS. 3*b* and 3*c*, during engagement between the partial-engaged position of FIG. 3*a* and a full-engagement position of FIG. 3*c*, the catch 74 may be pushed inward by its curved lower surface 86 engaging the forward edge 80 as the IDTs are engaged to facilitate engagement of the IDTs 12 and 14 from the first to full-engaged positions by pressing the finger 72 inward with engagement of the IDTs 12 and 14. In contrast, the upper surface of the catch 74 may be substantially perpendicular to the engagement axis 17 so as to resist disengagement without intentional inward pressing of the catch 74 by a tool or the like.

The material of the IDTs 12 and 14 may be, for example, brass, bronze, aluminum, steel, copper, or other conductive metals alone or plated. The use of steel permits joining copper and aluminum wiring where a copper wire is placed within one slot 34 and aluminum is placed in the second slot 34, for example, in the embodiments of FIG. 1 having multiple keyholes 28 and 30 where the steel reduces the galvanic action that would otherwise occur at a direct junction between, for example, aluminum and copper.

Figure 4:
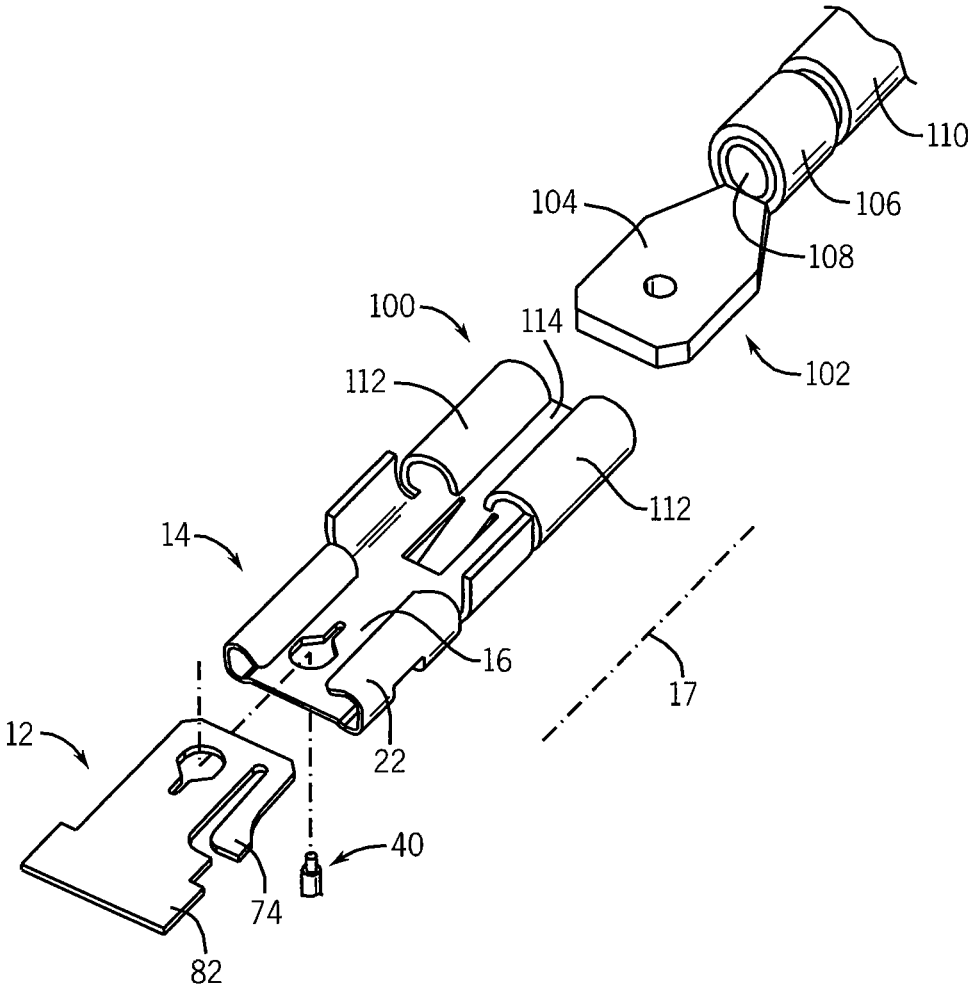
FIG. 4 is a perspective view of an alternative embodiment of the invention providing for attachment of the insulation displacement terminals to a releasable electrical connector.

Referring now to FIG. 4, IDT 14 may be integrally attached to a socket 100 for receiving a crimp connector 102 having a cab blade 104 attached to a crimp barrel 106. The crimp barrel is configured to receive conductors 108 of electrical wire 110. When the conductors 108 are received within the crimp barrel 106, a crimping force is applied to the barrel causing the electrically conducting walls of the crimp barrel 106 to inwardly deform and establish electrical connection with the conductors 108.

The Blade 104 may be received along the engagement axis 17 within the socket 100 and retained by rolled edges 112 against a base 114 of the socket 100 according to techniques well understood in the art. The IDT 12 is then received also along axis 17 from the opposite direction to engage with IDT 14 preventing interference between the two and providing a simple way to attach a conductor 44 to a crimp connector 102.

In an alternative embodiment not shown, crimp barrel 106 may be attached directly to the IDT 14.

Figure 5:
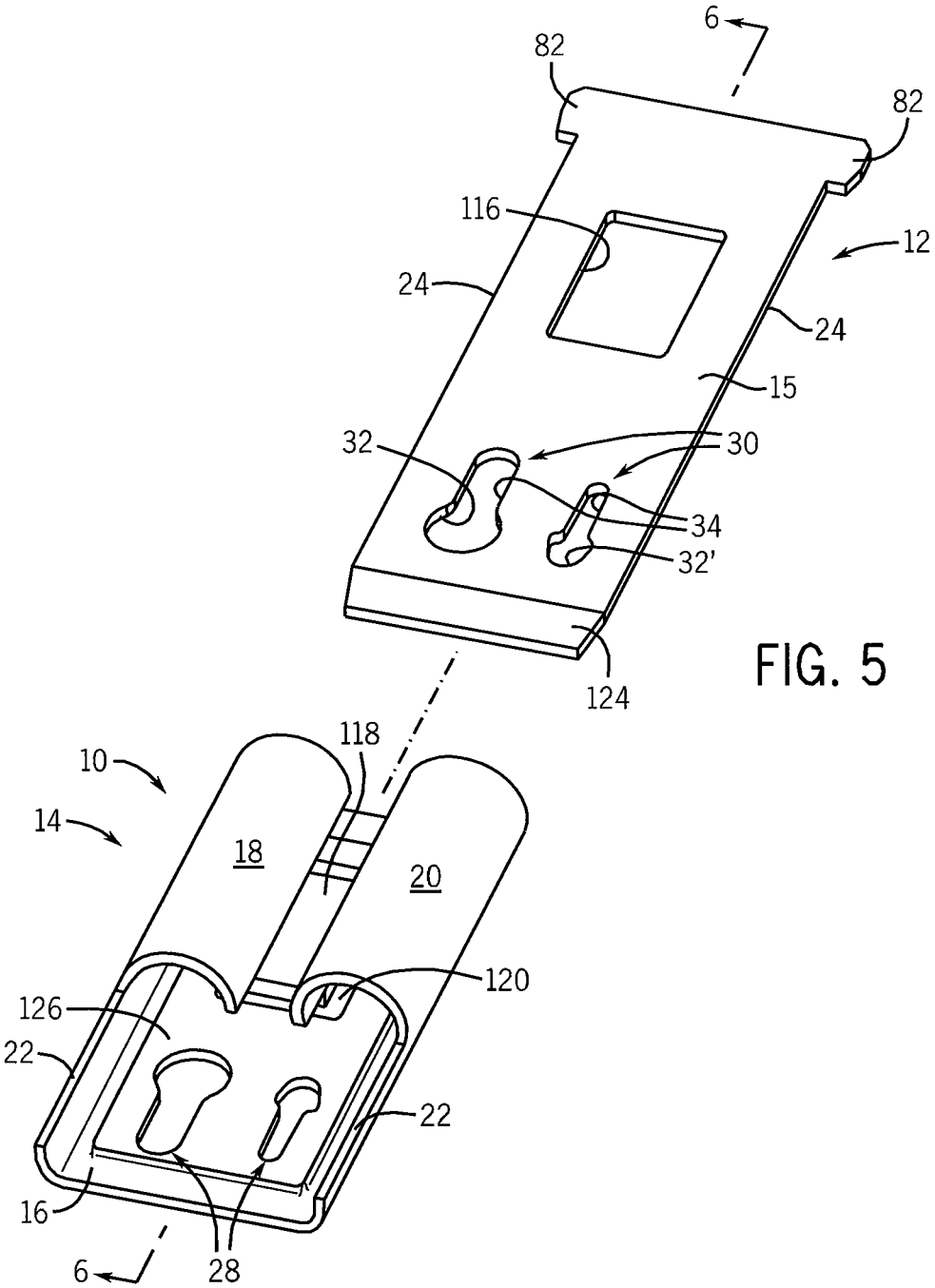
FIG. 5 is a perspective view of the first and second insulation displacement terminals in another embodiment of the present invention as shown side-by-side before connection.
Figure 6A:
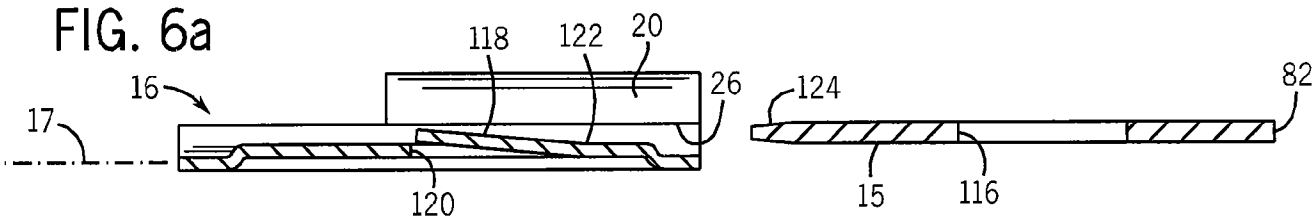
FIG. 6*a* is a cross-sectional view of the first and second insulation displacement terminals of FIG. 5 taken along line 6-6 of FIG. 5 as aligned before connection.
Figure 6B:
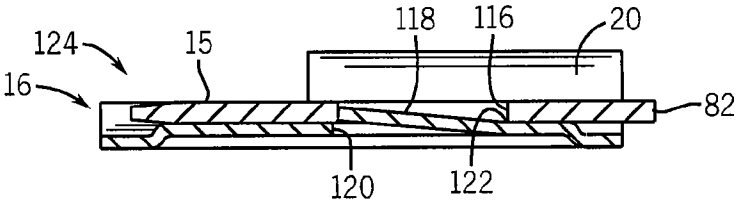
FIG. 6*b* is a figure similar to that of FIG. 6*a* showing the first and second insulation displacement terminals as assembled.

Referring now to FIG. 5, in an alternative embodiment of the invention, the plate 15 of the first IDT 12 may include a centrally located aperture 116. The base 16 of the second IDT 14 may in turn provide an upwardly biased cantilevered tab 118 formed on a corresponding surface of base 16 aligned with the aperture 116 when the first and second IDTs 12 and 14 are engaged. Referring to FIG. 6*a*, the cantilevered tab 118 may be formed by cutting three sides of a corresponding aperture 120 in base 16 to free the cantilevered tab 118 except at its leading edge 122 such as will first contact the plate 15 when the plate 15 is inserted along the insertion axis 17. As the plate 15 engages the second IDT 14, the leading edge 124 of the plate 15 presses the cantilevered tab 118 downward to allow passage of the plate 15 thereover until the cantilevered tab 118 and aperture 116 are aligned. At this point, the cantilevered tab 118 springs upward into the aperture 116 as shown in FIG. 6*b* to restrain the plate 15 from movement out of its engagement with rolled rails 26 (as has been described above) by abutment of the cantilevered end of the cantilevered tab 118 against a corresponding inner surface of the aperture 116. The plate 15 cannot be removed again without depression of the cantilevered tab 118 downward again, for example, using a tool such as the tip of a screwdriver or the like. The aperture 116 and cantilevered tab 118 thus serve similar purpose as that provided by aperture 76 and catch 74 described above.

Referring again to FIG. 5, the leading edge 124 of the plate 15 may be beveled to assist it in engagement with the edges of the rails 26 separated from the base 16 by a dimension somewhat thinner than the thickness of the plate 15 to provide compression of the plate on 15 when it is in engagement with the second IDT 14. A mesa 126 may be embossed upward in the base 16 to bias the plate 115 away from the curved portions of the walls 22 as they join the base 16 so that guidance between the edges 24 and the inner surfaces of the walls 22 is provided by interfitting parallel surfaces.

Figure 7:
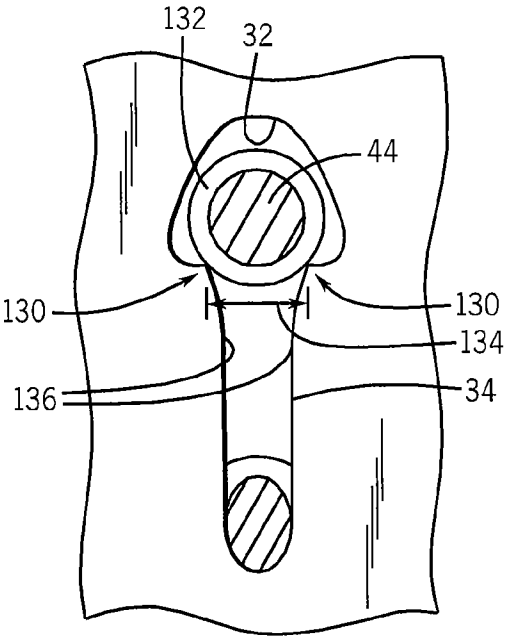
FIG. 7 is an elevational view of a keyhole slot with cutting edges for removing insulation from a constrained wire.

Referring now to FIG. 7, a junction between a clearance hole 32 and the slot 34 may provide for a chisel-edge 130 providing a cutting surface extending generally along the axis of the conductor 44 when the conductor 44 is inserted into the clearance hole 32 to cut an insulation 132, such as an enamel, from the conductor 44 as the conductor 44 is pressed into the slot 34. This cutting or skiving process may be necessary for certain insulations that are not removable by pressure alone. The edges formed by the junctions 130 may be spaced by a distance 134 slightly less than the undeformed diameter of the conductor 44 removing (skiving) the insulation and a small amount of the conductor.

A first portion of the slot 34 nearest the clearance hole 32 may provide for converging walls 136 which produced a compression of the conductor 44 after removal of the insulation 132, such compression necessary to provide the desired electrical contact between the conductor 44 and one or both of the IDTs 12 and 14.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there may be one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. All of the publications described herein, including patents and non-patent publications, are hereby incorporated herein by reference in their entireties.

I claim:

1. An insulation-displacement system comprising:

a first insulation-displacement terminal (IDT) and a second IDT, the first IDT adapted to slidably engage the second IDT along an engagement axis, each of the first and second IDTs comprising:

an associated plate that includes a slot extending along the engagement axis and configured to receive an electrical wire including a conductor surrounded by an insulator upon displacement of the insulator;

stop surfaces limiting the engagement of the first and second IDTs at a full-engaged position so that overlap of the slots of the engaged IDTs defines an aperture having an area corresponding to a predetermined gauge of the conductor; and detent surfaces releasably holding the first and second IDTs at the full-engaged position against disengagement.

2. The insulation displacement system of claim 1 wherein the first and second IDTs further provide alignment surfaces restraining relative motion of the first and second IDTs to a linear sliding abutment along the engagement axis.

3. The insulation displacement system of claim 2 wherein the alignment surfaces on the first IDT are first and second rolled edges extending parallel to the engagement axis to receive and capture corresponding first and second edges of the second IDT providing alignment surfaces of the second IDT.

4. The insulation displacement system of claim 3 wherein the stop surfaces on the first IDT are at least one leading edge of the first and second rolled edges receiving the second IDT and the stop surfaces on the second IDT are at least one flange extending outwardly from the plate perpendicular to the engagement axis to abut at least one leading edge of the first and second rolled edges at the full-engaged position.

5. The insulation displacement system of claim 3 wherein the detent surface on the first IDT is an opening in at least one of the first and second rolled edges and the detent surface on the second IDT is a spring-loaded catch biased outward to be received by the opening when the spring-loaded catch and opening are aligned at the full-engaged position.

6. The insulation displacement system of claim 5 wherein the spring-loaded catch is sized to be retained below an outer surface of the opening when engaged with the opening.

7. The insulation displacement system of claim 6 wherein the spring-loaded catch is attached to a cantilevered finger forming a part of the plate of the second IDT.

8. The insulation displacement system of claim 3 wherein the detent surface on the first IDT is an opening in at least one of the first and second plates and the detent surface on the second IDT is a cantilevered tab forming a part of the plate of the second IDT and a providing spring-loaded catch biased to be received by the opening when the cantilevered tab and opening are aligned at the full-engaged position.

9. The insulation displacement system of claim 8 wherein the spring-loaded catch is sized to be retained below an outer surface of the opening when engaged with the opening.

10. The insulation displacement system of claim 1 wherein at least one of the first and second IDTs provides electrical communication to a crimp barrel for deformation about a wire conductor.

11. The insulation displacement system of claim 1 wherein an opening formed by overlap of the slots of the first and second IDT at full-engagement position has a predefined shape and area.

12. The insulation displacement system of claim 1 wherein the slots of at least one of the first and second IDTs joins with a clearance hole allowing free passage of the electrical wire of the conductor surrounded by an insulator, the slots and clearance holes positioned so that at a partial-engaged position of the first and second IDTs along the engagement axis before reaching the full-engaged position, the clearance holes of the first and second IDTs align and in the full-engaged position only overlapping portion of the slots of the first and second IDTs align.

13. The insulation displacement system of claim 1 wherein a junction of a slot and clearance hole of at least one of the first and second IDTs provides at least one chisel-edge extending generally along an axis of the conductor when the conductor is received by the clearance hole, wherein the chisel-edge is spaced and oriented to cut insulation from the conductor as the conductor is moved from the clearance hole to the slot.

14. The insulation displacement system of claim 13 wherein each of the first and second IDTs provide multiple slots having clearance holes aligned at the partial-engaged position and overlapping portions of the insulation displacement slots aligned at the full-engaged position and wherein the slots have different widths for engaging conductors of different gauges and wherein the clearance holes associated with a slot for a narrower gauge is elongated along the engagement axis.

15. The insulation displacement system of claim 13 wherein the clearance hole and slot define a continuous periphery surrounded by material of the plate.

16. The insulation displacement system of claim 13 wherein each of the first and second IDTs provide multiple slots having clearance holes aligned at the partial-engaged position and overlapping portions of the insulation displacement slots aligned at the full-engaged position.

17. The insulation displacement system of claim 16 wherein the plates of the first and second IDTs are steel.

18. A method for electrically coupling an electrical conductor surrounded by an insulator to an electrical contact, the method comprising:

(a) positioning an electrical wire having a conductor surrounded by an insulator within slots of a first insulation-displacement terminal (IDT) and a second IDT, the first IDT adapted to slidably engage the second IDT along an engagement axis, and the first and second IDT each comprising an associated plate that includes the slots to extend along the engagement axis, the slots receiving the electrical wire after displacement of the insulator;

(b) apply force along the engagement axis to slide the first and second IDTs together until stop surfaces of the first and second IDTs limit the engagement of the first and second IDTs at a full-engaged position so that overlap of the slots defines an aperture having an area corresponding to a predetermined gauge of the conductor and to engage detent surfaces of the first and second IDTs that releasably hold the first and second IDTs at the full-engaged position against disengagement.

19. The method of claim 18 wherein the slots of at least one of the first and second IDTs join with a clearance hole allowing free passage of the electrical wire of the conductor surrounded by an insulator, the slots and clearance holes positioned so that at a partial-engaged position of the first and second IDTs along the engagement axis before reaching the full-engaged position, the clearance holes of the first and second IDTs align and, in the full-engaged position only, the overlapping portion of the slots of the first and second IDTs align;

wherein the step of positioning the electrical wire within the slots includes the steps of positioning the electrical wire within the clearance holes at the partial-engaged position and then sliding the first and second IDTs along the engagement axis to the full-engaged position to move the wire into the slots.

20. The method of claim 18 wherein each of the first and second IDTs provide multiples slots having clearance holes aligned at a partial-engaged position and overlapping portions of the slots aligned at the full-engaged position and wherein the plates are steel and wherein the step of positioning an electrical wire positions a first wire with a copper conductor in a first slot and a second wire with an aluminum wire in a second slot.

* * * * *